US009016682B2

(12) United States Patent
Law et al.

(10) Patent No.: US 9,016,682 B2
(45) Date of Patent: Apr. 28, 2015

(54) ITEM LOCATION

(71) Applicant: NCR Corporation, Duluth, GA (US)

(72) Inventors: Neil Law, Dundee (GB); Bob Suttie, Fife (GB); David Heighton, Fife (GB); Willy Kaempfer, Bern (CH); Finbarr Williamson, London (GB); Rod Haines, Cambridge (GB)

(73) Assignee: NCR Corporation, Duluth, GA (US)

( * ) Notice: Subject to any disclaimer, the term of this patent is extended or adjusted under 35 U.S.C. 154(b) by 0 days.

(21) Appl. No.: 13/720,373

(22) Filed: Jan. 24, 2013

(65) Prior Publication Data

US 2014/0203498 A1 Jul. 24, 2014

(51) Int. Cl.

| | |
|---|---|
| ***B65H 29/24*** | (2006.01) |
| ***B65H 1/00*** | (2006.01) |
| ***B65H 29/32*** | (2006.01) |

(52) U.S. Cl.

CPC ..... *B65H 1/00* (2013.01); *B65H 29/32* (2013.01); *B65H 29/243* (2013.01)

(58) Field of Classification Search

CPC ..... B65H 29/243; B65H 29/32
USPC ..... 271/194–197, 276, 307, 311, 312, 314, 271/177, 178

See application file for complete search history.

(56) References Cited

U.S. PATENT DOCUMENTS

| | | | | |
|---|---|---|---|---|
| 2,752,154 | A | 6/1956 | Nelson | |
| 3,545,746 | A * | 12/1970 | Clayton et al. | 271/196 |
| 4,190,241 | A * | 2/1980 | Krueger | 270/47 |
| 4,437,659 | A * | 3/1984 | Caron et al. | 271/276 |
| 4,440,388 | A * | 4/1984 | Divoux et al. | 271/195 |
| 4,754,962 | A * | 7/1988 | Kontz | 271/307 |
| 4,966,521 | A * | 10/1990 | Frye et al. | 414/788.8 |
| 5,108,085 | A * | 4/1992 | Smith et al. | 271/276 |
| 5,329,301 | A * | 7/1994 | Balzeit et al. | 346/134 |
| 6,623,001 | B2 * | 9/2003 | Steinkogler et al. | 271/176 |
| 6,889,897 | B2 * | 5/2005 | Nomiyama et al. | 235/379 |
| 7,722,024 | B2 * | 5/2010 | Jeong | 271/3.08 |
| 7,770,889 | B2 * | 8/2010 | Ong et al. | 271/284 |
| 8,002,279 | B2 * | 8/2011 | Chetrit Russi et al. | 271/312 |
| 8,123,222 | B2 * | 2/2012 | Ong | 271/276 |

* cited by examiner

*Primary Examiner* — Luis A Gonzalez
(74) *Attorney, Agent, or Firm* — Joseph P. Mehrle

(57) ABSTRACT

A method and apparatus are disclosed for loading at least one media item into a media item container. The apparatus includes at least one rotatable member comprising an outer surface including a plurality of apertures connected to at least one chamber where a negative pressure is selectively provided. The apparatus also includes a guide that guides each incoming item of media transported to the rotatable member. The rotatable member is rotatable when negative pressure is provided at the chamber region to locate a media item secured to the rotatable member by suction from the guide into the media item container.

7 Claims, 8 Drawing Sheets

FIG. 1
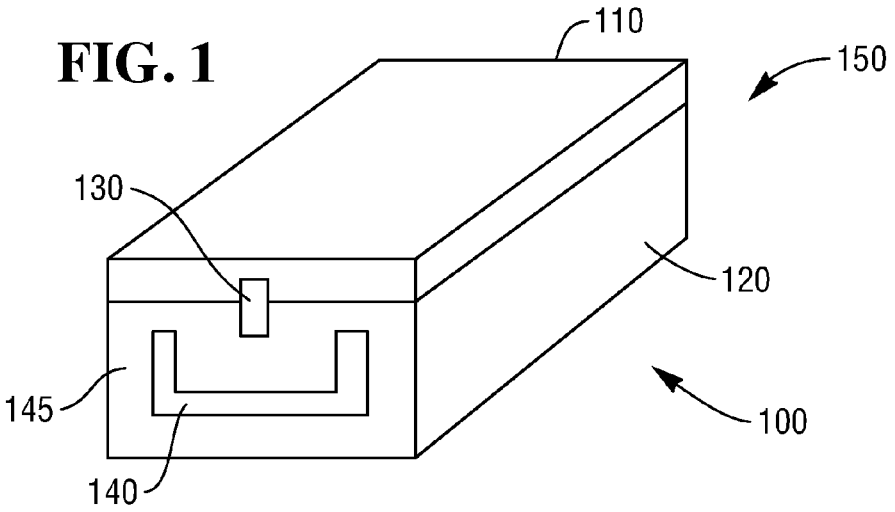
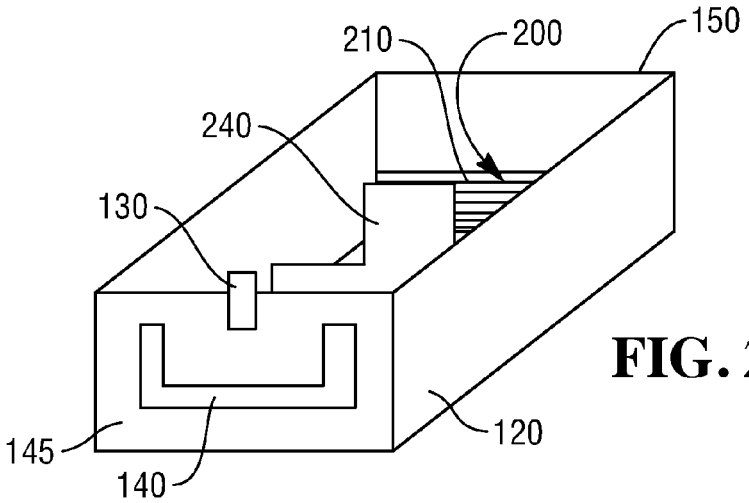
FIG. 2
FIG. 3
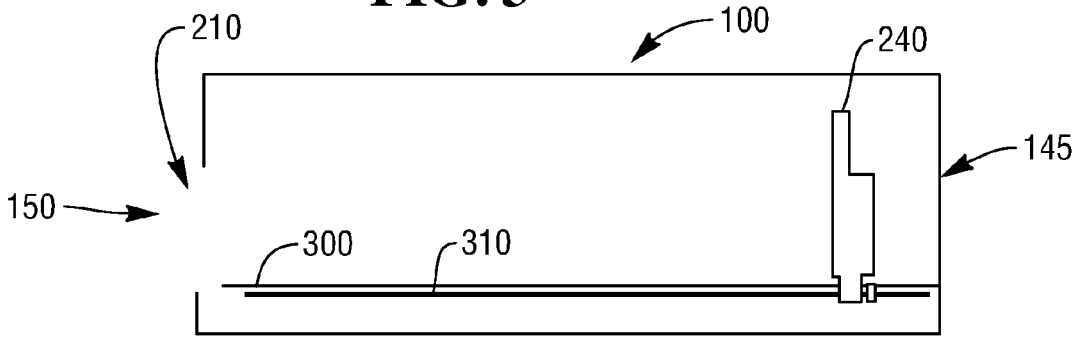

ITEM LOCATION

FIELD OF THE INVENTION

The present invention relates to a method and apparatus for locating items of media. In particular, but not exclusively, the present invention relates to a media cassette replenisher and its method of automated use whereby a guide is used to guide currency notes to a pick window of a media cassette and then a perforated vacuum drum is utilized to automatically load the currency notes into the media cassette.

BACKGROUND TO THE INVENTION

Media storage cassettes are used to store media in sheet form for automated picking and dispensing in many types of self-service terminal (SST). For example, one particular type of media cassette is a currency cassette which may be used in Automated Teller Machines (ATMs). An ATM may include multiple media cassettes in the form of currency cassettes with each cassette storing currency notes having a respective value.

A typical currency cassette stores thousands of currency notes in a neat array. This neat array of banknotes is urged towards a picking area by a sprung plate which ensures that the neat array in the currency cassette is maintained in contact with the picking area as currency notes are removed from the cassette one-by-one.

In the past, to replenish the currency cassette with currency notes, a lid of the currency cassette was removed, and then the sprung plate was retracted and an array of new bank notes then placed between the retracted sprung plate and the picking area. It is quite difficult for one person to retract the sprung plate and insert the array of new bank notes whilst holding the sprung plate in its retracted position. It is also time consuming to remove the lid of the currency cassette.

The recent currency industry trend associated with ATMs, which is for closed cycle cash management, is resulting in customers looking for ways to load and move cassettes between equipment without an operator touching the currency notes. This would reduce the chance of operator error and additionally, would obviate the need for extra security personnel to monitor cash transfers into the currency cassette. This would also enable financial institutions to relax their double custody rules which must otherwise be employed when currency notes are transported from one place to another. Until now, a suitable solution to this long felt need has been lacking.

Similar considerations are also appropriate for the removal of currency notes from a currency cassette or indeed the formation of a bunch of currency notes or removal of currency notes from a bunch within an SST such as an ATM.

SUMMARY OF THE INVENTION

It is an aim of the present invention to at least partly mitigate the above-mentioned problems.

It is an aim of certain embodiments of the present invention to support a closed cash cycle environment.

It is an aim of certain embodiments of the present invention to provide a method and apparatus for loading currency notes into a currency cassette which prevents the need for an authorized operator to touch the cassette, sprung plate and currency notes during a loading process.

It is an aim of certain embodiments of the present invention to provide a method of loading legacy currency cassettes whereby a re-design of currently in use currency cassettes is not required to facilitate the automation of a loading process.

It is an aim of certain embodiments of the present invention to provide a method and apparatus for dispensing currency notes from a currency cassette.

It is an aim of certain embodiments of the present invention to provide a method and apparatus for forming a bunch of currency notes.

It is an aim of certain embodiments of the present invention to provide a method and apparatus for picking currency notes from a bunch of currency notes.

According to a first aspect of the present invention there is provided apparatus for loading at least one media item into a media item container, comprising:

- at least one rotatable member comprising an outer surface including a plurality of apertures connected to at least one vacuum chamber where a negative pressure is selectively provided; and
- a guide that guides each incoming item of media transported to the rotatable member; wherein
- the rotatable member is rotatable when negative pressure is provided at the chamber region to locate a media item from the guide into the media item container.

Aptly, each rotatable member comprises a central body including at least one through hole and a substantially cylindrical sleeve located around an outer surface of the central body and comprising a plurality of apertures in fluid communication with said through hole.

Aptly, the sleeve is interchangeable, at least one characteristic of a sleeve being dependent upon a type of media item being located.

Aptly, each sleeve is made from an elastomeric material having a high co-efficient of friction and/or a low stiffness. The sleeve's high co-efficient of friction and the pinch rollers work together with the vacuum pressure to reliably deliver an item of media. The sleeve's low stiffness allows the sleeve to deform easily against creased or unsmooth or damaged items of media.

Aptly, the rotatable member comprises a substantially cylindrical body comprising a plurality of through holes, a first end of each through hole providing a respective aperture in the outer surface of the cylindrical body.

Aptly, the apparatus further includes an item release guide member that locates a media item away from said outer surface when a media item is located in the media item container.

Aptly, the item release guide member is interchangeable and has at least one characteristic dependent upon a type of media item being located.

Aptly, the apparatus further includes at least one pinch roller opposed to the outer surface and comprising at least one flexible flapper member.

Aptly, the pinch roller is carried on a biased pivotable arm. This helps enable the mechanism to reach through the note aperture and into the cassette.

Aptly, a guide surface moves with the pivotable arm and is disposed to turn an incoming media item at a location proximate to where the media item is released from the rotatable member.

Aptly, the at least one vacuum chamber comprises a plurality of vacuum chambers spaced circumferentially about a central axis.

Aptly, a negative pressure is selectively provided in each vacuum chamber independently.

Aptly, the apparatus further comprises a ratchet member that engages with a pusher plate in the media item container and is selectively locatable to provide corresponding selective location of the pusher plate. This helps control the pusher plate, relieving pressure on the note array for notes to be delivered into the cassette. Control of the pusher plate movement also helps control alignment of the deposited note stack. This in turn helps align notes in the cassette.

Aptly, the apparatus further comprises a shroud disposed to occlude a plurality of the apertures.

Aptly, the shroud provides a fluid tight seal closing each occluded aperture.

Aptly, the rotatable member rotates with respect to the shroud to selectively occlude and reveal apertures dependent upon a rotatory position of the shroud with respect to the rotatable member.

Aptly, a leading edge of the shroud is aligned with the item release guide member.

Aptly, the media item comprises a currency note and the media item container comprises a currency note cassette.

Aptly, the apparatus is in a Self-Service Terminal (SST) or a Teller Assisted Unit (TAU) or a Staff Operated Device (SOD).

Aptly, the SST is an Automated Teller Machine (ATM).

According to a second aspect of the present invention there is provided a method of loading at least one media item into a media item container, comprising the steps of:

releasably securing a media item to a rotatable member disposed proximate to an opening inlet of a media item container; and rotating the rotatable member thereby repositioning the media item from a guide proximate to the rotatable member into the media item container.

Aptly, the method further comprises the steps of releasing the media item from the rotatable member via an item release guide that urges a leading edge of a media item away from the rotatable member as the rotatable member rotates and the media item is located in the media item container.

Aptly, the method further comprises the steps of, releasably securing the media item by providing a negative pressure in at least one vacuum chamber of the rotatable member; and applying the negative pressure at a surface of the media item via a plurality of fluid communication passageways between the vacuum chamber and said surface.

Aptly, the method further comprises turning a leading edge of an incoming media item via a guide surface as the media item is located in the media item container.

According to a third aspect of the present invention there is provided a method of loading a media item into a media item container, comprising the steps of:

securing a media item to a rotatable drum member by applying a negative pressure at a surface of a media item located against the drum member at a first location outside the media item container; and rotating the drum member thereby re-locating the media item from the first location to a further location inside said media item container.

According to a fourth aspect of the present invention there is provided apparatus for locating at least one media item comprising:

at least one rotatable member comprising an outer surface including a plurality of apertures connected to at least one vacuum chamber where a negative pressure is selectively provided; and a guide that guides each incoming item of media transported to the rotatable member; wherein the rotatable member is rotatable when negative pressure is provided at the chamber region to locate a media item from the guide to a pre-determined location.

According to a fifth aspect of the present invention there is provided a method of locating at least one media item, comprising the steps of:

releasably securing a media item to a rotatable member disposed proximate to a pre-determined location; and rotating the rotatable member thereby repositioning the media item from a guide proximate to the rotatable member to the pre-determined location.

According to a sixth aspect of the present invention there is provided a method of locating a media item, comprising the steps of:

securing a media item to a rotatable drum member by applying a negative pressure at a surface of a media item located against the drum member at a first location; and rotating the drum member thereby re-locating the media item from the first location to a further pre-determined location.

Certain embodiments of the present invention make use of the spring loaded nature of currency cassettes and allow legacy cassette designs to be loaded without substantive design changes to the cassettes themselves.

Certain embodiments of the present invention provide the advantage that storage cassettes may be loaded/replenished with items of media in an automated way.

Certain embodiments of the present invention enable media items to be located in a media item container using negative pressure and a rotating drum-like member. Such a mechanism is clean and is not prone to error.

Certain embodiments of the present invention use a multi-chamber drum-like member which is rotatable to locate media items. Partitioning a vacuum chamber in the center of a drum means that a negative pressure can be generated more quickly than by generating a negative pressure in the whole of central region. Also, a positive pressure is optionally applicable to one or more chambers to help assist removal of media items from an outer surface of the rotating member at selected times/rotational locations.

Certain embodiments of the present invention utilize a ratcheting mechanism which can pull a pusher plate of a media item container away from a location where new media items are loaded. This relieves a pressure at a front of a stack of media items so that incoming media items can be loaded more effectively.

Certain embodiments of the present invention provide a beneficial way of loading a cassette relative to conventional systems. There is no need to carefully time incoming notes. The system is quicker and has less moving parts so is less prone to error.

Certain embodiments of the present invention provide a way of picking items of media from a currency cassette in an automated way.

Certain embodiments of the present invention provide a method and apparatus for forming a bunch of currency notes or picking currency notes from a bunch of currency notes in a highly automated secure way.

BRIEF DESCRIPTION OF DRAWINGS

Embodiments of the present invention will now be described hereinafter, by way of example only, with reference to the accompanying drawings in which:

FIG. 1 is a schematic perspective diagram of a media cassette in the form of a currency cassette;

FIG. 2 illustrates a schematic view of a body portion of the currency cassette shown in FIG. 1 with the lid removed;

FIG. 3 is a simplified sectional side view of the body portion of the cassette shown in FIG. 1 and FIG. 2;

DESCRIPTION OF EMBODIMENTS

Figure 4:
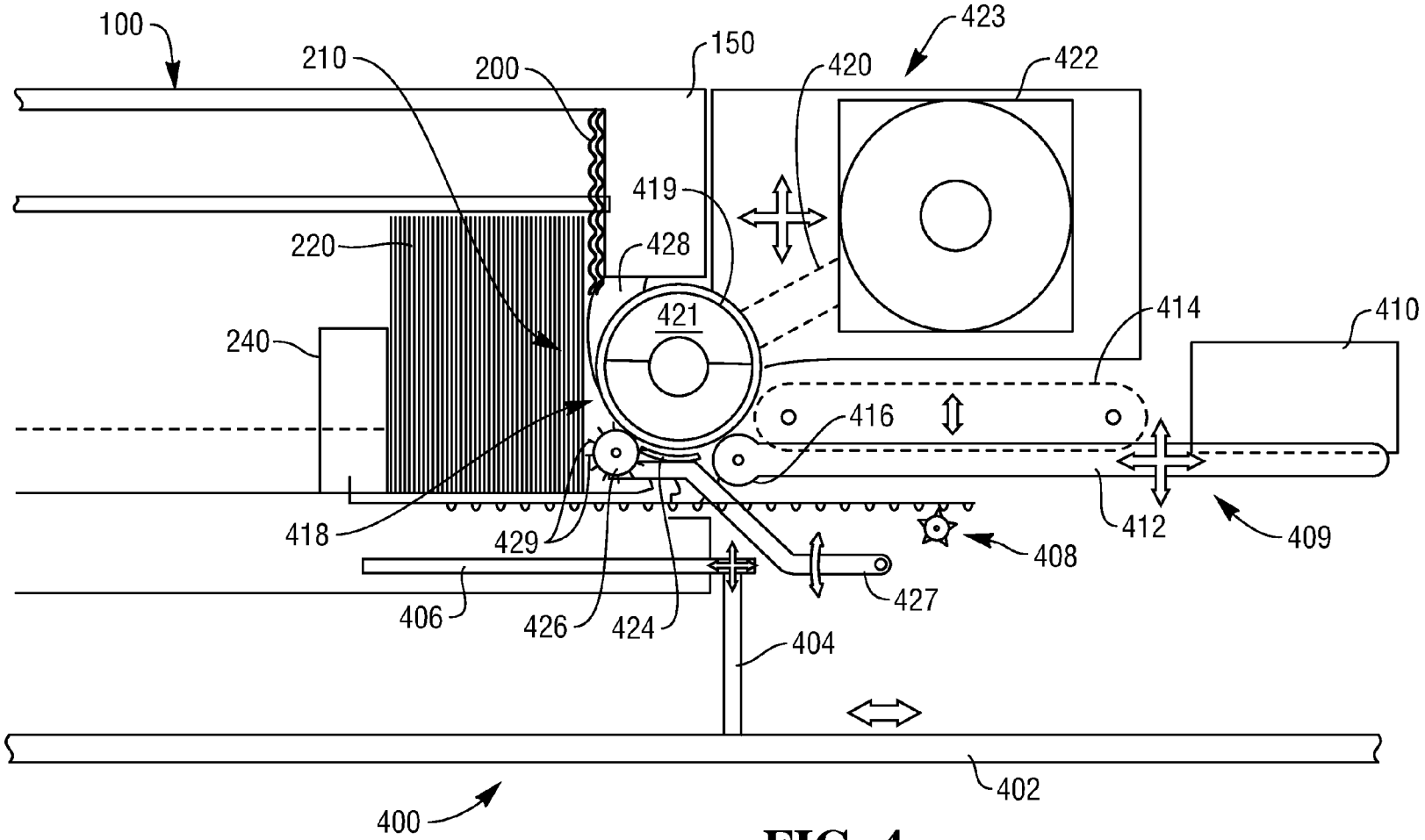
FIG. 4 illustrates a currency cassette replenishment terminal which can be used to replenish currency notes in a currency cassette of the type shown in FIGS. 1 to 3.

In the drawings like reference numerals refer to like parts.

FIG. 1 illustrates a media cassette 100 in the form of a polycarbonate currency cassette for storing currency notes (sometimes referred to as banknotes). The cassette 100 shown in FIG. 1 has a lid 110 secured to a body 120 by a latch 130. The cassette body 120 has a handle 140 at a first end 145 which is spaced apart from a further end 150 of the cassette 100. The handle end 145 is referred to as a "non-picking end". A closed pick window (shown more clearly in FIG. 2) is located at the opposite end 150 which is referred to as a "picking end".

As illustrated in FIG. 2 which illustrates the cassette 100 shown in FIG. 1 with the lid 110 removed, the picking end 150 includes a roller shutter 200 which covers a pick window 210 when the currency cassette 100 is being transported. When the currency cassette 100 is inserted into a currency dispenser (not shown), for example, in an Automated Teller Machine (ATM), tines (not shown) in the currency dispenser (not shown) engage with blocks (not shown) mounted in channels (not shown in FIG. 2) defined in the body 120 to raise the roller shutter 200 and open the pick window 210. FIG. 2 also illustrates how a pusher plate 240 is located inside the currency cassette 100 to help urge a stack of currency notes towards the pick window end 150 of the currency cassette 100.

FIG. 3 helps illustrate how the cassette 100 includes a floor 300 beneath which a central rail 310 is provided that extends longitudinally along the length of the cassette 100 from the non-picking end 145 towards the picking end 150. The biased pusher plate 240 is slidably mounted on the central rail 310 and is coupled thereto by a ratchet mechanism (not shown). The pusher plate 240 pushes a stack of currency notes thereby urging them towards the pick window 210 so that when the pick window 210 is open, currency notes can be picked through the pick window 210 by a currency dispenser (not shown).

With reference to FIG. 4, a currency cassette replenishment terminal comprises a chassis assembly, indicated generally at 400, having a base member 402 and a vertical wall 404 which stands upright on the base member 402 and extends transversely of the terminal, that is, perpendicularly to the plane of the figure. Tines 406 extend horizontally from the free end of the wall 404 at various points along its extent, in a direction opposite to the direction of insertion of a currency cassette, that is, from right to left as viewed in the figure. A currency cassette 100, of the type described with reference to FIGS. 1 to 3, is inserted into the terminal from left to right as viewed in the figure, for currency note replenishment. The cassette 100 is almost completely depleted save for a small stack of notes 220 at the picking end 150. In the inserted position of the cassette 100, the picking end 150 is adjacent a currency replenishment mechanism, indicated generally at 423 (described in more detail hereinafter), which is mounted on the chassis assembly, with the tines 406 being inserted into the cassette 100 (as described hereinabove), so as to raise the roller shutter 200 and open the pick window 210. The pressure applied by the pusher plate 240 to the stack 220 is controlled by a ratchet mechanism 408. This ratchet mechanism can selectively be driven to drive the pusher plate away from the pick window end by a desired amount thus selectively relieving pressure on the front of the stack to permit easier loading of new notes.

A note feeder mechanism, indicated generally at 409, is mounted on the chassis assembly 400. The mechanism 409 comprises a note input module 410, lower guide rails 412 (only one of which is visible in FIG. 4) and upper endless conveyer belts 414 (shown schematically as a dotted line). The note input module 410 is at one end (the right hand end as viewed in the figure) of the guide rails 412 and conveyer belts 414. At the other end is a guide roller 416 which forms part of the currency note replenishment mechanism 423.

In addition to the guide roller 416, the currency replenishment mechanism 423 comprises: a vacuum cylinder assembly 418; a drive motor 422; a drive belt 420; a pinch roller 426 mounted at the end of a cranked, pivotal arm 427; a turn guide 424, also mounted on the arm 427; and, a release guide 428. The arm 427 is pivotably mounted at the end opposite to the pinch roller 426 and is urged towards the cylinder assembly 418. Both the guide roller 416 and the pinch roller 426 are driven to co-rotate with the cylinder assembly 418 (anti-clockwise as viewed in the figure). The pinch roller 426 is also provided with a number of radially outwardly extending, resilient flapper fingers 429 spaced equally around its outer surface.

The cylinder assembly 418 comprises a drum-like member having a wall 419, the interior surface of which defines a central bore 421 which is connected to a vacuum pump (not shown), so as to form a vacuum chamber. When the pressure in the vacuum chamber is reduced, by pumping air out with a vacuum pump (not shown) air is sucked into the vacuum chamber through apertures (not shown) in the wall 419. Optionally, the central bore is partitioned so that the whole bore does not need to be pumped out at any one time.

The drive belt 420 is driven by the motor 422 and drivably connected to the cylinder assembly 418 so as to drive the cylinder assembly 418 in rotation (clockwise as viewed in FIG. 4).

Currency notes are supplied from the feeder mechanism 409 to the note replenishment mechanism 423 where they are picked up by the cylinder assembly 418 and taken to the currency cassette 100, there being deposited through the pick window 210 so as to join the stack of notes 220 already in the cassette 100.

The notes are conveyed one at a time in a manner typical of ATMs using guide rail and conveyer feeder mechanisms between the note input module 410 and the guide roller 416. The guide roller 416 is positioned adjacent to the vacuum cylinder assembly 418 so as to guide a note as it leaves the feeder mechanism closely enough to the cylinder assembly 418 that the vacuum chamber sucking action through the apertures causes the note to be grabbed by the cylinder assembly 418. The note is then held against the cylinder assembly 418 by the sucking action as the cylinder assembly 418 is rotated, the turn guide 424 and pinch roller 426 ensuring, particularly if the note is especially stiff, that the note remains held by the cylinder assembly 418. The resilient fingers 429 yield to the note as it passes the pinch roller 426. The note continues to rotate with the cylinder assembly 418 until its leading edge reaches the guide member 428 which is so shaped as to come between the leading edge and the and the cylinder assembly and to prise the leading edge away from the cylinder assembly 418. With the trailing edge still held by the cylinder assembly 418, continued rotation of the cylinder assembly 418 drives the leading edge through the pick window 210, into the currency cassette 100. Next, following further rotation of the cylinder assembly 418, the trailing edge is prised away from the cylinder assembly 418 and the trailing edge is acted upon by the again extended flapper fingers 429, thereby urging the note against the stack of existing notes 220.

Figure 5:
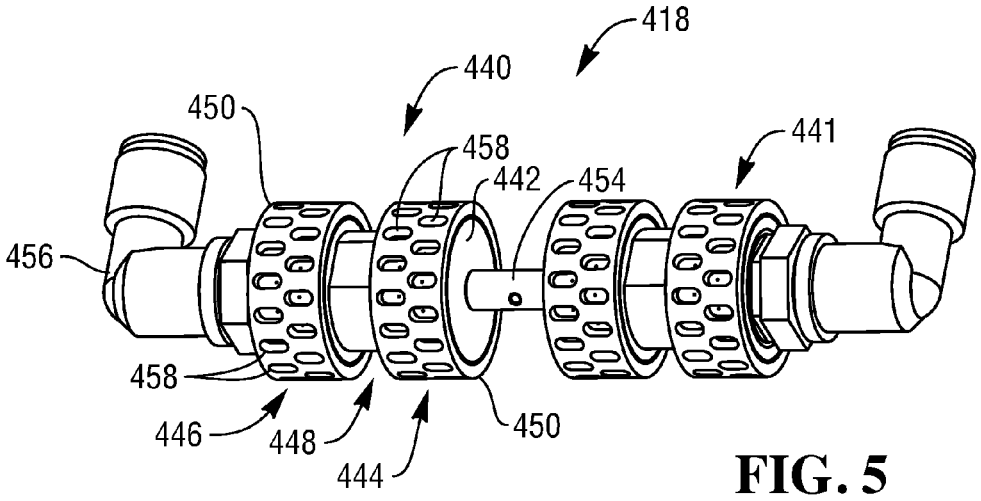
FIG. 5 illustrates rotating drums each having outer perforated sleeves.
Figure 6:
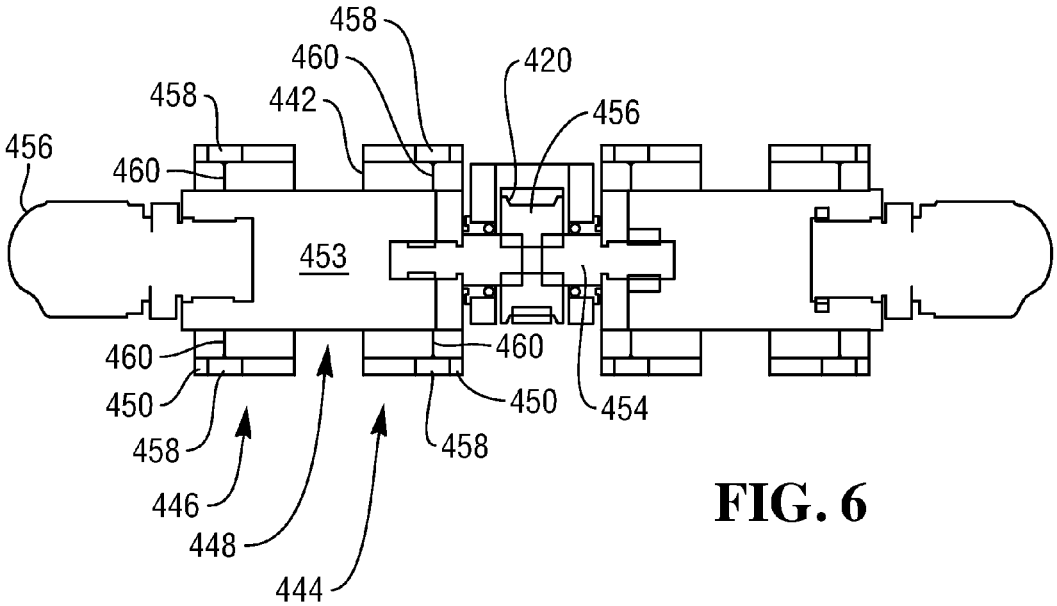
FIG. 6 illustrates a cross-section through the rotating members shown in FIG. 5.
Figure 7:
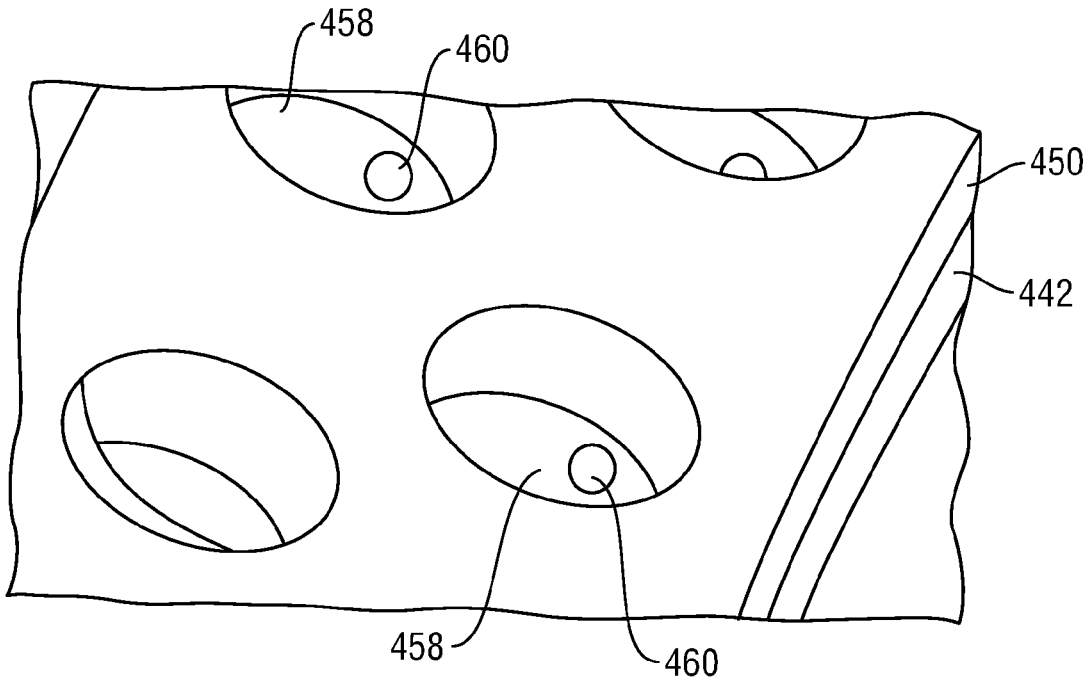
FIG. 7 illustrates a magnified view of apertures in a sleeve and apertures in an inner rotating body.

A specific embodiment of vacuum cylinder assembly is illustrated in FIGS. 5, 6 and 7. This particular assembly comprises a drum-like member divided into two sub-assemblies 440, 441 arranged in a mirror image fashion, with each sub-assembly 440, 441 comprising a separate vacuum chamber. For the sake of clarity, only one of the sub-assemblies will be described.

The sub-assembly 440 comprises a wall 442 with a reduced diameter center portion 448 defining a right hand increased diameter end portion 444 and a left hand increased diameter end portion 446. Each increased diameter end portion 444, 446 is provided with an outer sleeve 450 made from an elastomeric material with a high coefficient of friction. The interior surface of the wall 442 defines a central bore 453 which serves as a vacuum chamber. The end of the right hand end portion 444 adjacent to the center of the assembly 418 is fixed to a spindle 454. The opposite end of the left hand end portion 446 is freely rotatable about one end of a pipe elbow 456, the other end of which is connected via a hose (not shown) to a vacuum pump (not shown). A pulley 456 is mounted on the center spindle 454 and the drive belt 420 from the drive motor 422 drives the pulley 456 so as to rotate the sub-assembly 440.

Each outer sleeve 450 has a series of apertures 458 arranged in two parallel circumferential ring formations with the apertures in each ring equally spaced and offset from the apertures in the other ring. For each aperture 458 there is a corresponding hole 460 in the wall 442, such that each aperture 458 is in communication with the vacuum chamber 453. Hence, when the pressure in the vacuum chamber 453 is reduced, air is sucked through the apertures 458, which enables the sub-assembly 440 to grab a currency note as described above.

Optionally, there might not be 1 to 1 correspondence between apertures 458 in the sleeve and holes 460 in the wall 442. There may be many small holes or slits in the wall with less larger holes in the wall 442.

Aptly, the aperture size is about around 0.30 mm in diameter. Aptly, the apertures are in the range of about around 0.1 to 0.50 mm.

Each outer sleeve is removably slid onto its corresponding end part 444, 446 so as to be interchangeable with other sleeves having different aperture 458 sizes and/or arrangements and/or of material with a different coefficient of friction. Whilst the sleeve can have apertures having a substantially cylindrical shape (common diameter along a length through the sleeve material) alternative profiles of aperture may optionally be selected. For example, a 'cup like' aperture can have a relatively narrow waist close to the cylinder which flares out towards the outer surface of the sleeve. This helps reduce a volume of space in which a negative pressure should be established but helps maximize a possible holding force on a note.

Aptly, the apertures include precision drilled restrictor holes to transmit the vacuum whilst helping to prevent vacuum loss when there is no item of media present.

Figure 8:
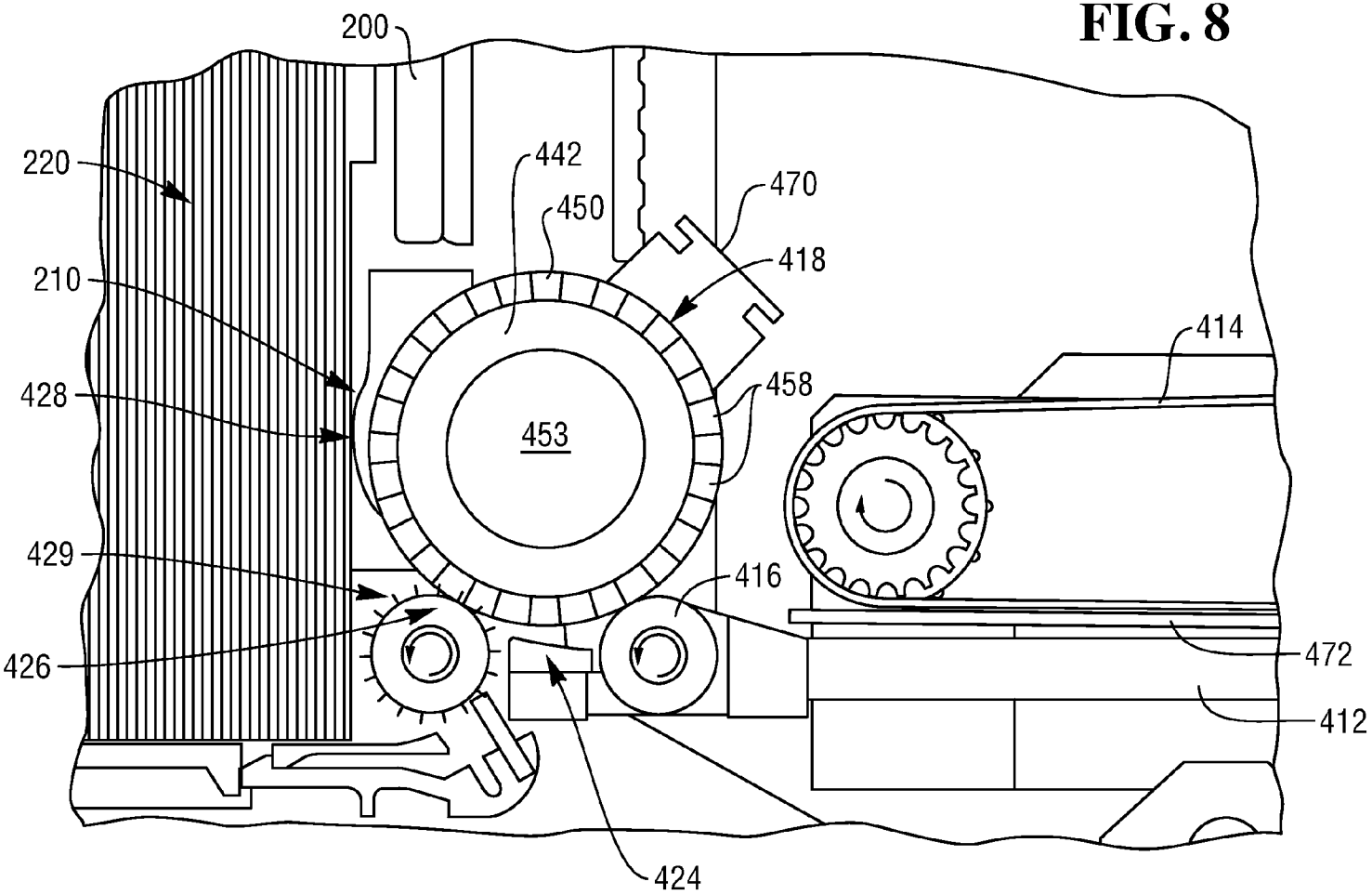
FIG. 8 illustrates an incoming media item as it moves towards a rotating member where negative pressure is applied.
Figure 9:
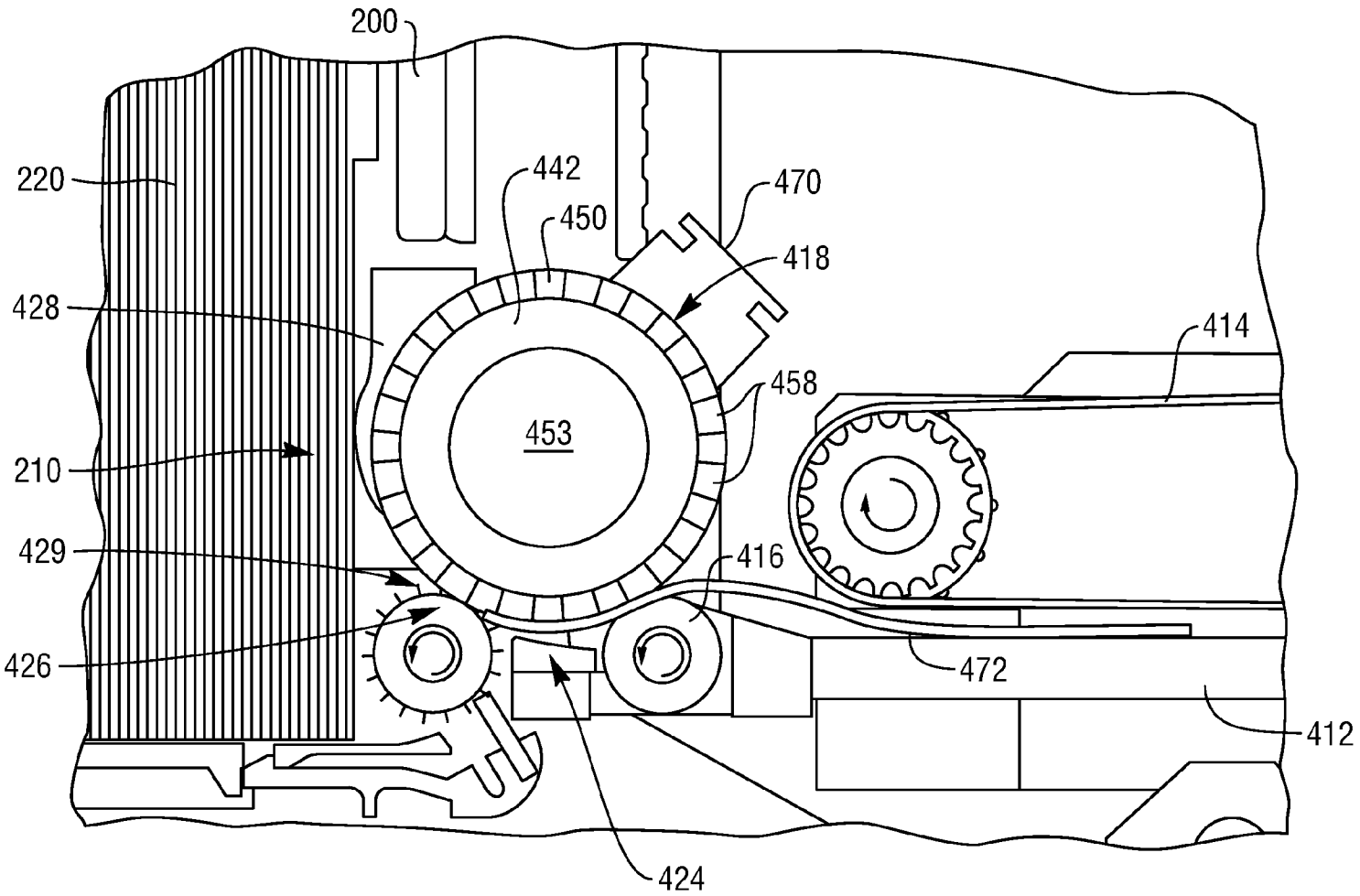
FIG. 9 illustrates the pathway taken by a media item as it moves into a container.
Figure 10:
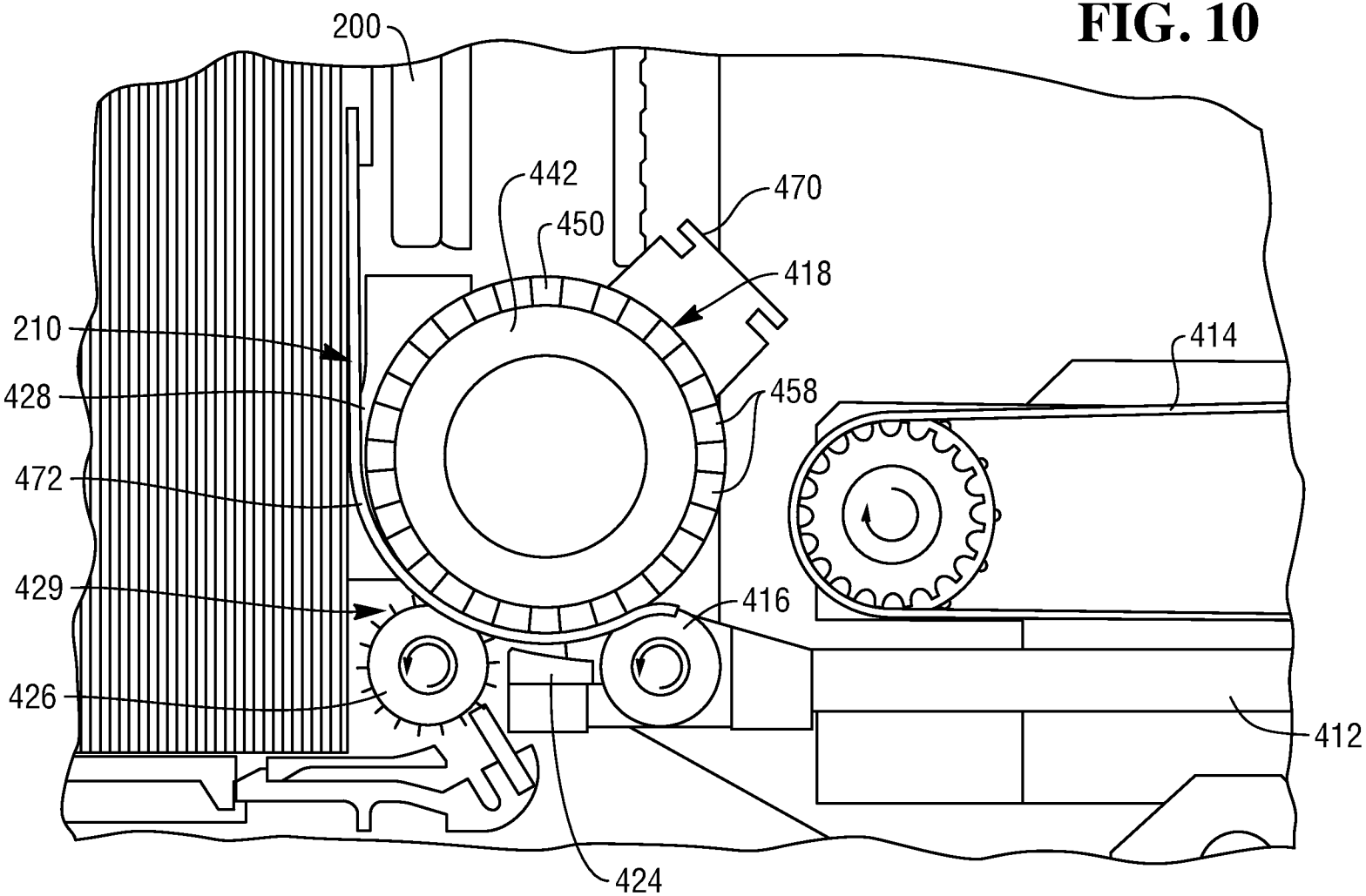
FIG. 10 illustrates the media item as it is loaded into a stack within a media item container.

The cylinder assembly 418 described with reference to FIGS. 5, 6 and 7 is shown in FIGS. 8, 9 and 10 incorporated into a currency cassette replenishment terminal (like parts to those shown in FIG. 4 have been given the same reference numerals). In addition, a vacuum pump 470 is shown in FIGS. 8, 9 and 10.

In FIG. 8, a currency note 472 is shown at the end of the note feeder mechanism 409, approaching the guide roller 416. In FIG. 9, the note 472 is shown having been guided by the guide roller 416 to the cylinder assembly 418 which has grabbed the note and rotated it past the turn guide 424 and towards the pinch roller 426. In FIG. 10, the note 472 is shown, with the cylinder assembly 418 having rotated further such that the release guide 428 has prised the leading edge of the note away from the cylinder assembly 418, having had its leading edge driven through the pick window, into the currency cassette 100 against the existing stack of notes 220.

Optionally the vacuum chamber is segregated into separate chambers by one or more partition walls. A negative pressure may be generated in each chamber independently so that a volume to be pumped is reduced with respect to the whole volume inside the drum. This enables the negative pressure to be generated more rapidly and/or allows a smaller capacity (cheaper) pump to be utilized. Optionally a positive pressure can be generated in one or more chambers at selected times. This helps blow currency notes off the drum into the stack.

Figure 11:
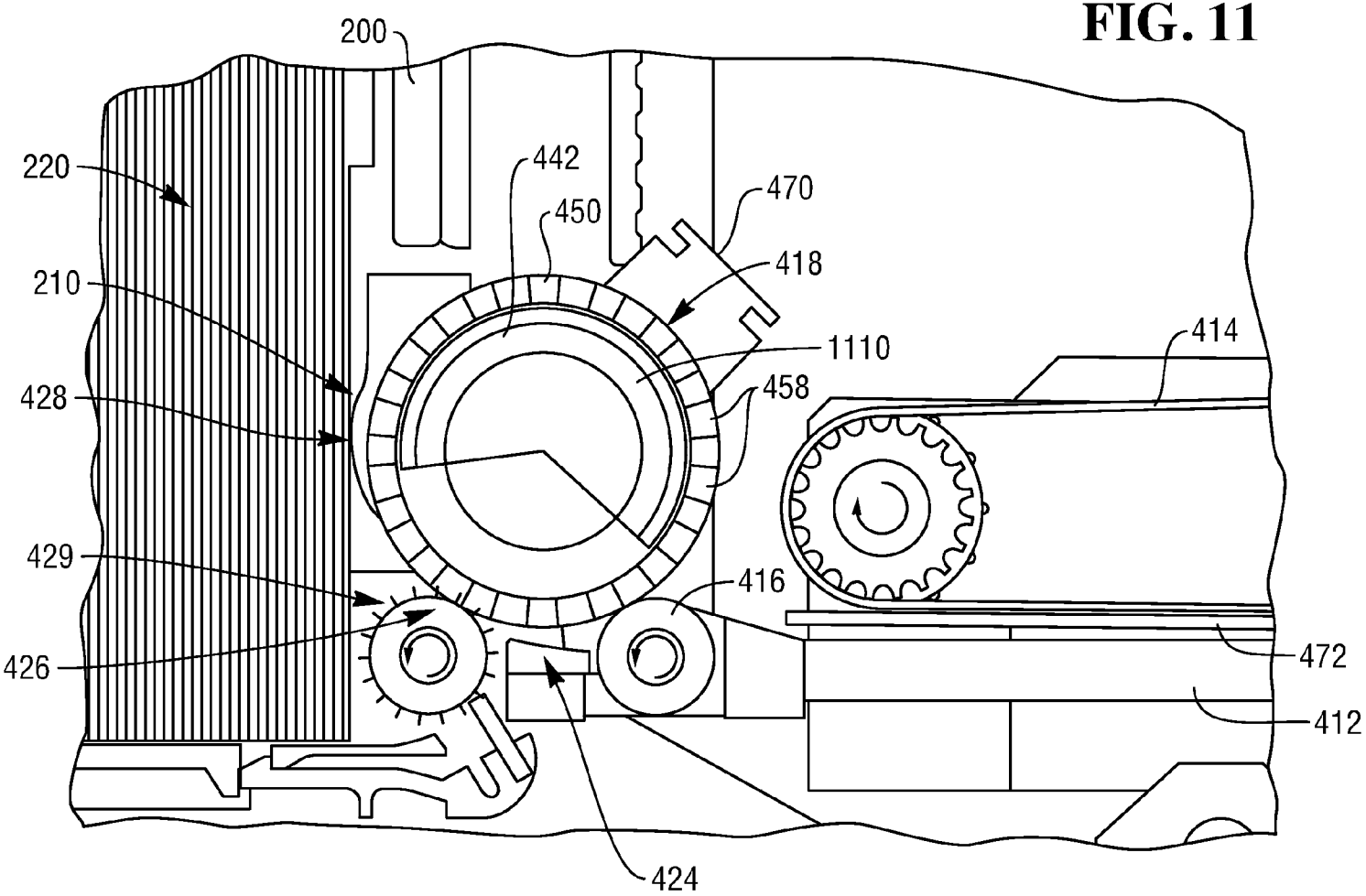
FIG. 11 illustrates use of a pressure shield in the cylinder assembly.

FIG. 11 illustrates an alternative embodiment of the present invention in many ways similar to that previously described. However, a shroud 1110 is included in the cylinder assembly 418 in the embodiment shown in FIG. 11. The shroud 1110 shields the apertures 458 from the negative pressure in the central bore where the shroud is located. The shroud does not extend so as to shield apertures used to pick up an incoming item of media, move it across the pinch rollers and then deposit the item in the cassette. By effectively forming a seal over many of the apertures of the cylinder assembly, it is easier to generate sufficient negative pressure at the apertures which remain open and which are actually utilized to transport items of media. It will be appreciated that the shroud 1110 remains stationery and fixed in position whilst the surrounding sleeve rotates with respect to the shroud. Items of media are thus "adhered" to the rotating outer sleeve 450 by means of the negative pressure in the cylinder assembly which is communicated via apertures 458 which remain open.

Aptly, the separate parts of the vacuum assembly are modular in nature. This enables parts to be selected according to specific use. For example, a width of the outer sleeve selected can be chosen to adjust for different currency note widths or other such parameters.

Aptly, a release point is selected for where the item of media is released from the rotating cylinder assembly. For relatively stiff items of media (such as new currency notes) it is better to have the item released from between the main vacuum cylinder and the pinch roller lower down relative to a position of the item stack. For very limp items of media (such as old, well used currency notes) it is better to release the note from between the vacuum cylinder and pinch roller.

Aptly, certain embodiments of the present invention can be utilized to pick items of media such as currency notes from a container such as a currency cassette rather than or in addition to selectively loading such items into the container. It will be appreciated that if items are being picked then the drum assembly is driven in an opposite way to that described hereinabove (for example, anti-clockwise).

It will also be appreciated that whilst certain embodiments of the present invention have been described hereinabove in detail and with reference to the loading or unloading of items of media from a container, certain other embodiments of the present invention are not restricted to such use with a container. Rather, such embodiments can be utilized to pick from or supply items of media to create or reduce a bunch of items of media which may then be transported to another location in a conventional manner.

Throughout the description and claims of this specification, the words "comprise" and "contain" and variations of them mean "including but not limited to" and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of the features and/or steps are mutually exclusive. The invention is not restricted to any details of any foregoing embodiments. The invention extends to any novel one, or novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

What is claimed is:

1. Apparatus for loading at least one media item into a media item container, the apparatus comprising:

at least one rotatable member comprising an outer surface including a plurality of apertures connected to at least one vacuum chamber where a negative pressure is selectively provided;

a guide that guides each incoming item of media transported to the rotatable member;

wherein the rotatable member is rotatable when negative pressure is provided at the chamber region to locate a media item from the guide into the media item container; and at least one pinch roller opposed to the outer surface and comprising at least one flexible flapper member, wherein the pinch roller is carried on a biased pivotable arm, and wherein a guide surface moves with the pivotable arm and is disposed to turn an incoming media item at a location proximate to where the media item is released from the rotatable member.

2. The apparatus as claimed in claim 1, further comprising:

each rotatable member comprises a central body including at least one through hole and a substantially cylindrical sleeve located around an outer surface of the central body and comprising a plurality of apertures in fluid communication with said through hole.

3. The apparatus as claimed in claim 2, further comprising:

the sleeve is interchangeable, at least one characteristic of a sleeve being dependent upon a type of media item being located.

4. The apparatus as claimed in claim 2 wherein each sleeve is made from an elastomeric material having a high co-efficient of friction.

5. The apparatus as claimed in claim 1, further comprising:

the rotatable member comprises a substantially cylindrical body comprising a plurality of through holes, a first end of each through hole providing a respective aperture in the outer surface of the cylindrical body.

6. The apparatus as claimed in claim 1, further comprising:

an item release guide member that locates a media item away from said outer surface when a media item is located in the media item container.

7. The apparatus as claimed in claim 6 wherein the item release guide member is interchangeable and has at least one characteristic dependent upon a type of media item being located.

* * * * *